US008025261B2

(12) United States Patent
Jordan et al.

(10) Patent No.: US 8,025,261 B2
(45) Date of Patent: Sep. 27, 2011

(54) COMBINATION STAND AND JACK FOR WIRE SPOOLS

(75) Inventors: David Jordan, Knoxville, TN (US); Michael Jordan, Knoxville, TN (US)

(73) Assignee: Southwire Company, Carollton, GA (US)

( * ) Notice: Subject to any disclaimer, the term of this patent is extended or adjusted under 35 U.S.C. 154(b) by 419 days.

(21) Appl. No.: 12/208,232

(22) Filed: Sep. 10, 2008

(65) Prior Publication Data

US 2009/0065663 A1 Mar. 12, 2009

Related U.S. Application Data

(60) Provisional application No. 60/971,518, filed on Sep. 11, 2007.

(51) Int. Cl.
*F16M 11/38* (2006.01)

(52) U.S. Cl. ..... 248/168; 248/439; 248/188.6; 254/126; 254/251

(58) Field of Classification Search ..... 248/166, 248/168, 169, 170, 171, 439, 188.1, 188.2, 248/188.5, 188.6, 421; 254/126, 251, 112, 254/114, 119, 124, 264; 242/129.5, 129.6, 242/168, 559.1, 559.4, 598.4, 598.5
See application file for complete search history.

(56) References Cited

U.S. PATENT DOCUMENTS

| | | | | | |
|---|---|---|---|---|---|
| 1,888,761 | A * | 11/1932 | Foyer | 254/126 |
| 4,030,704 | A * | 6/1977 | Beierle et al. | 242/129.5 |
| 4,092,012 | A * | 5/1978 | Ishigami | 254/126 |
| 4,502,390 | A * | 3/1985 | Shaw | 248/421 |
| 4,583,713 | A * | 4/1986 | Fukura et al. | 254/126 |
| 4,746,078 | A * | 5/1988 | Setzke | 242/559.1 |
| 4,752,047 | A * | 6/1988 | Franks, Jr. | 248/166 |
| 5,467,969 | A * | 11/1995 | Kobayashi et al. | 254/251 |
| 6,299,100 | B1 * | 10/2001 | Cloud | 242/598.5 |
| 7,040,059 | B2 * | 5/2006 | Hodsdon et al. | 52/127.2 |

OTHER PUBLICATIONS

Product Advertisement and description, www.greenlee.com, circa 2007.

* cited by examiner

*Primary Examiner* — Tan Le
(74) *Attorney, Agent, or Firm* — Hope Baldauff Hartman, LLC

(57) ABSTRACT

A stand used for supporting spools of wire and the like includes a cam which is operable to increase the length of a leg to thereby raise the spool of wire off of the ground. The stand is adjustable to allow its use with different sizes of spools of wire. The stand allows a single person to raise a spool of wire weighing thousands of pounds off of the ground and support the same to allow the spool to rotate freely upon an axle.

22 Claims, 7 Drawing Sheets

COMBINATION STAND AND JACK FOR WIRE SPOOLS

RELATED APPLICATIONS

The present application claims the benefit of U.S. Provisional Application Ser. No. 60/971,518, filed Sep. 11, 2007, which is expressly incorporated herein by reference.

BACKGROUND OF THE INVENTION

1. The Field of the Invention

The present invention relates to jacks and support stands. More specifically, the present invention relates to an improved jack and support stand for holding a spool of electrical wire or the like while working with the wire.

2. State of the Art

Installing electrical wires in commercial, industrial, or municipal applications typically involves wires of significantly greater length and diameter than in an ordinary home. The wires are typically installed by pulling the same through a previously installed electrical conduit. As such, these wires are typically available on large spools. Spools of wire for these types of applications are often three feet or larger in diameter, and may weigh more than a thousand pounds.

To facilitate installation of the wire, the spool of wire is mounted on a stand by placing an axle (such as a steel pipe) through the axis of the spool and placing the axle ends on the stand. The spool rotates about the axle as the wire is pulled from the spool into the conduit. Existing stands are undesirable as they require a person to exert a large amount of force to lift the spool off of the ground and onto the stand to thereby allow the spool to spin freely. Larger spools of wire may require multiple persons or even machinery to lift on to the stands. Available stands are also undesirable as there is some danger of the axle falling off of the top of existing stands due to the lateral forces which may be applied when installing the wire into a conduit. Thicker wires will often require a relatively high force to pull the wire from the spool, and this force may displace the spool from the stand. It will be appreciated that this creates a safety danger for persons working around the spool of wire, especially where the spool of wire is heavy and not easily moved by a single person.

There is thus a need for an improved stand for supporting spools of wire during installation. There is need for a stand which incorporates a lifting mechanism which allows a person to lift a spool of wire off of the ground with minimal effort. There is need for a stand which securely holds the axle while allowing the axle and spool of wire to turn freely while dispensing wire. There is also a need for a stand which is stable, minimizing the risk of accidents while in use.

SUMMARY OF THE INVENTION

It is an object of the present invention to provide an improved stand for supporting spools of wire.

According to one aspect of the invention, a stand is provided which includes an integrated lifting mechanism. The lifting mechanism allows a person to lift a spool weighing 2000 pounds with a relatively small amount of effort.

According to another aspect of the invention, a stand is provided which captures and securely holds the axle used for supporting the spool of wire, eliminating the risk that the axle is pulled horizontally off of the stand during use. The stand may use a clamp that holds the axle, and may use bearings on the clamp to allow for easy rotation of the axle.

According to another aspect of the invention, a stand is provided which is adjustable to accommodate different sizes of spools. The stand may incorporate one or more adjustable support legs to alter the height of the stand, and may allow the position of the legs to be altered on a base member to maintain the stability and functionality of the stand. Thus, a person need only have a single pair of stands to use with a variety of different spool sizes.

According to another aspect of the invention, the stand may be collapsible to allow for convenient storage and transportation of the stand.

These and other aspects of the present invention are realized in a combination stand and jack for wire spools as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
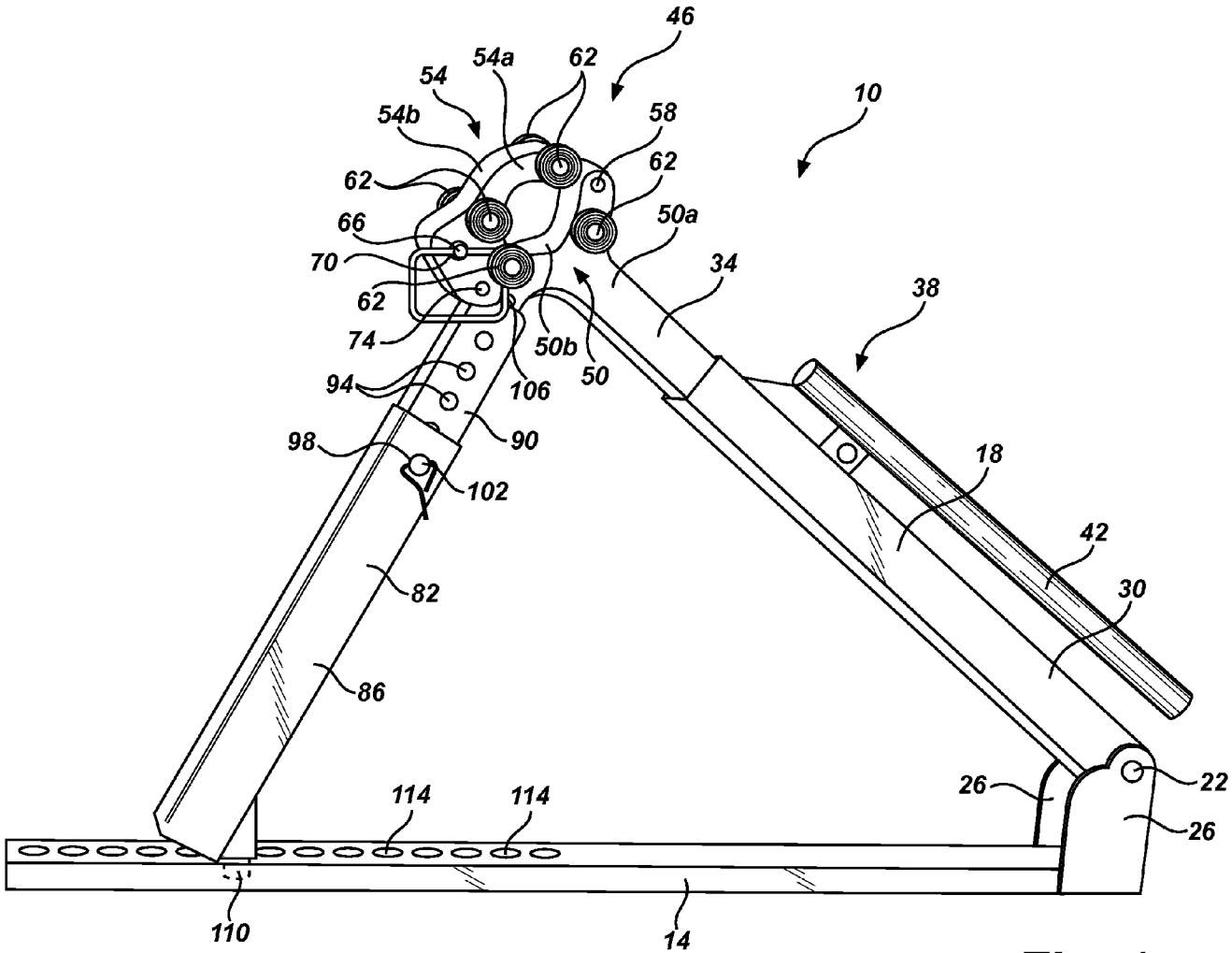
FIG. 1 shows a perspective view of a combination stand and jack according to the present invention.

Turning now to FIG. 1, a perspective view of a stand 10 according to the present invention is shown. The stand 10 includes a base 14 which rests on the ground during use. A rear leg 18 is pivotably attached to the base 14 at pivot 22. Pivot 22 may be formed with side plates 26 which are attached to the base 14 and which receive the rear leg 18 therebetween.

The rear leg 18 is telescopic, and includes an outer tube 30 and an inner tube 34. A jack 38 is used to extend and retract the inner tube 34 relative to the outer tube 30. Pivoting the lever 42 away from the outer tube 30 retracts the inner tube 34, and lowering the lever 42 towards the outer tube 30 extends the inner tube 34. According to a preferred embodiment, the jack 38 uses a cam action to extend or retract the inner tube 34. The jack 38 is used to lift a spool of wire off of the ground once the stand is properly positioned.

Figure 5:
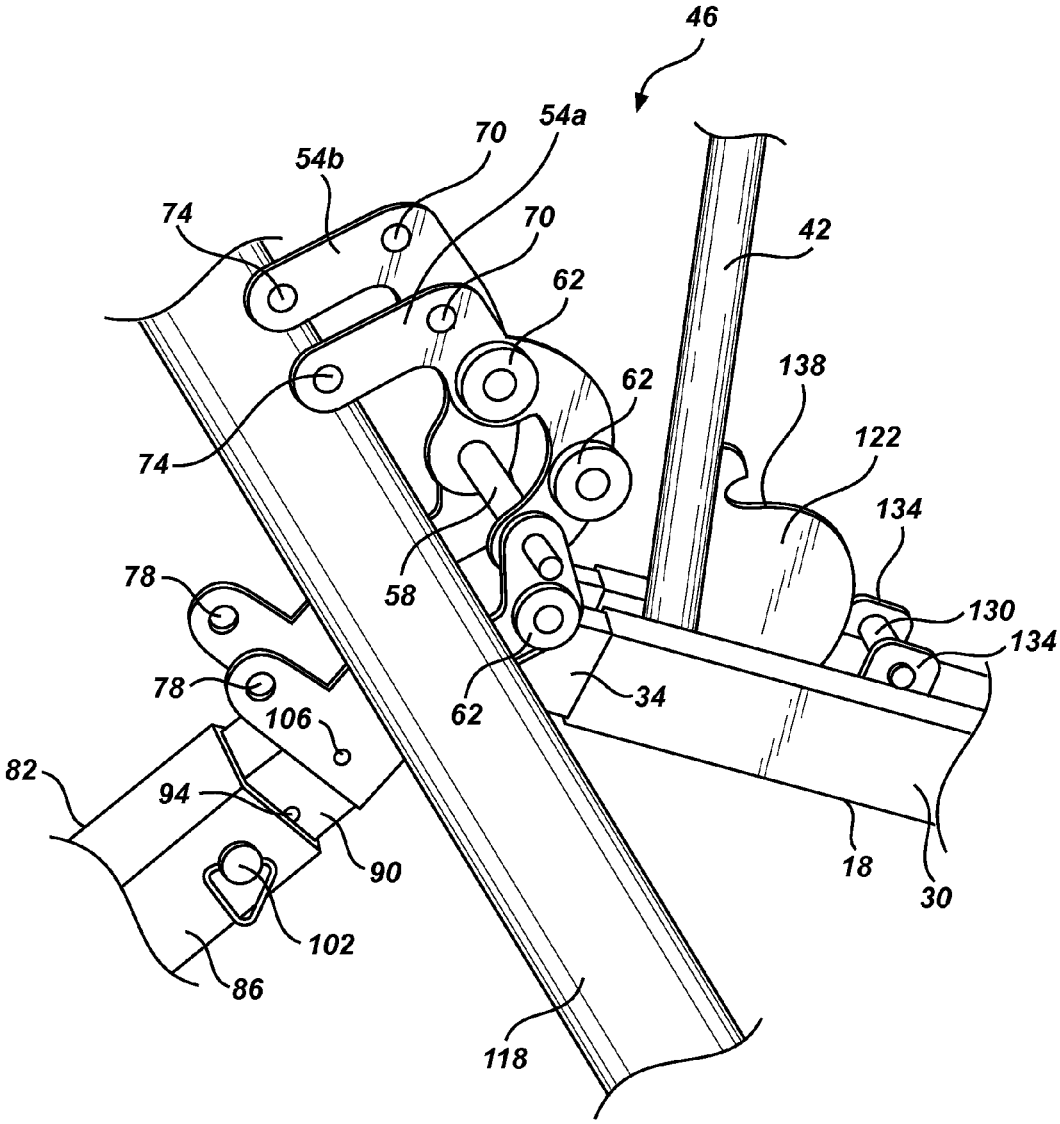
FIG. 5 shows a perspective view of the jaw of the stand of FIG. 1.
Figure 6:
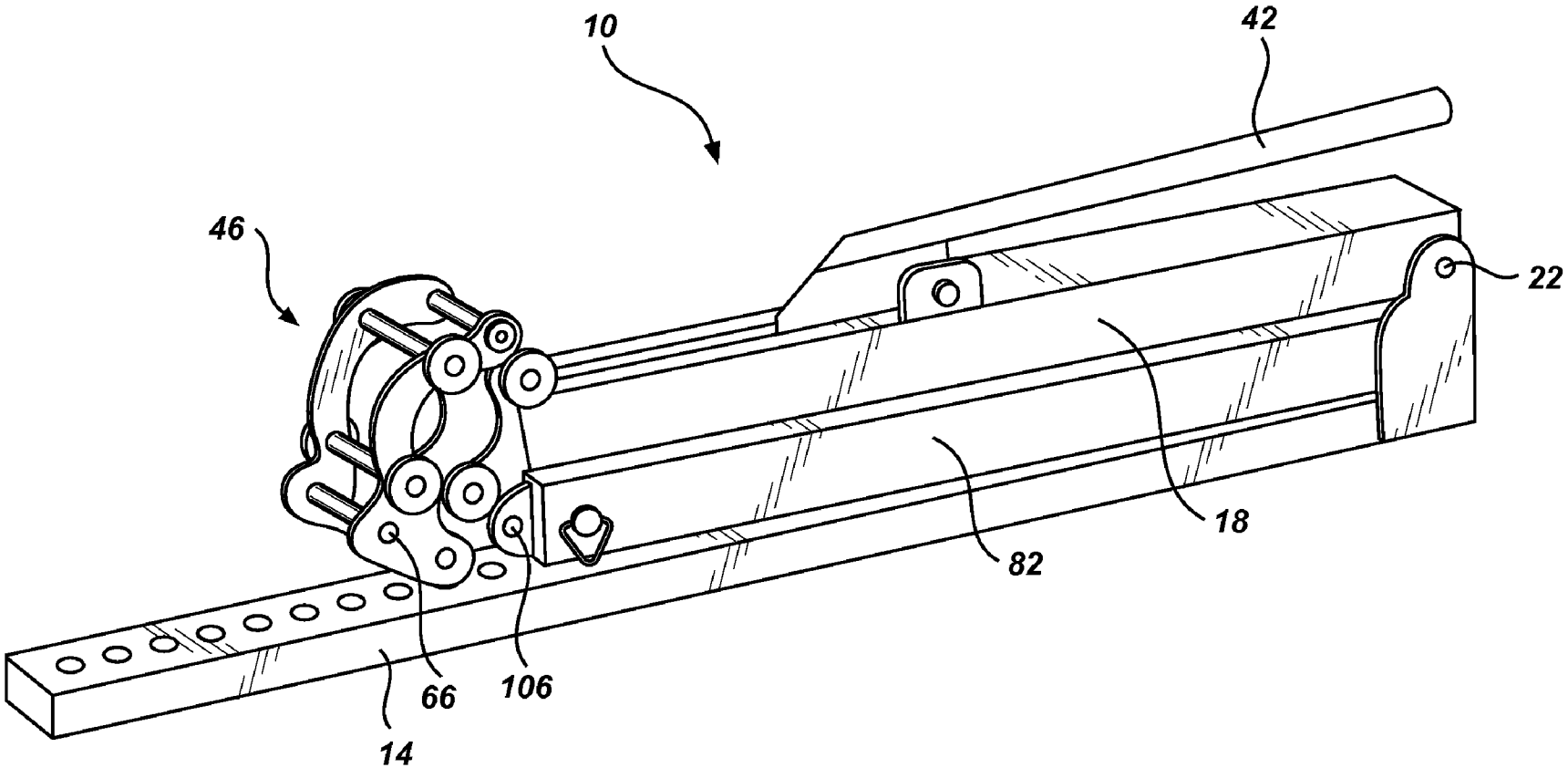
FIG. 6 shows a perspective view of the stand of FIG. 1.
Figure 7:
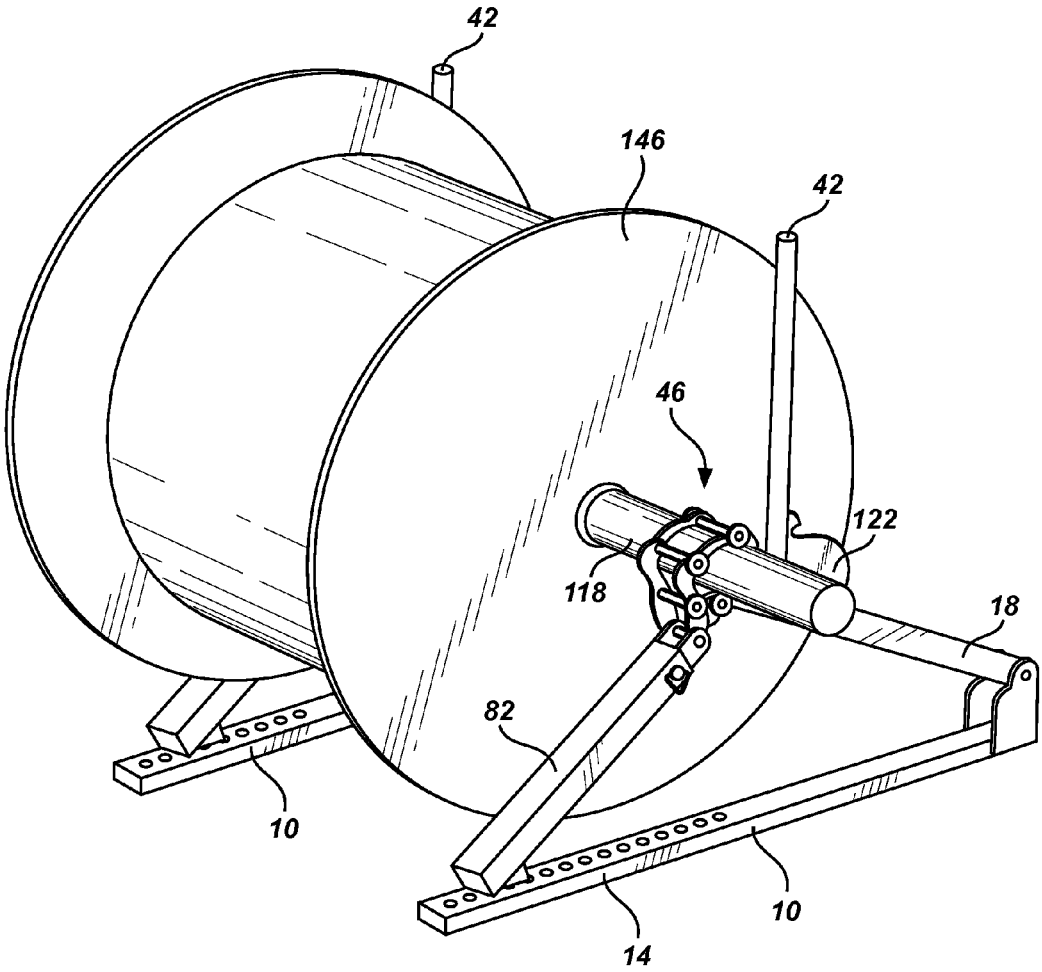
FIG. 7 shows a perspective view of a pair of the stands of FIG. 1 in use.

The inner tube 34 is connected to a clamping jaw, generally indicated at 46, which holds the axle used to support the spool of wire (FIGS. 5-7). The jaw 46 includes a fixed base portion 50 that includes left and right halves 50*a*, 50*b* and a clamping portion 54 which also includes left and right halves 54*a*, 54*b*. The clamping portion 54 is pivotably attached to the base portion 50 at pivot 58. The jaw 46 is formed from two sides (designated a and b) to aid in holding the axle and to keep the axle perpendicular to the jaw 46, helping to brace the stand 10 laterally when in use and preventing the stand from falling over. A plurality of bearings 62 are attached to the jaw 46 such that only the bearings 62 contact an axle when the axle is clamped in the jaw 46. A presently preferred embodiment includes four bearings 62 attached to the base portion 50*a*, 50*b* (two bearing on either side of the base portion) and four bearings attached to the clamping portion 54 (two bearings on either side of the clamping portion). It will be appreciated that a different number of bearings 62, such as 6 or 10, may also be used.

The clamping portion 54 is held in a closed position as shown by passing a pin 66 through holes 70 or 74 formed in the clamping portion and a corresponding hole 78 (FIG. 2) formed in the base portion 50. Two holes 70, 74 are formed in the clamping portion 54 so as to allow for two sizes of axles. Three holes may be formed in the clamping portion 54, or another hole may be formed in the base portion 50 to accommodate additional sizes of axles. Hole 70 is positioned such that a 1.5 inch pipe is held in the jaw 46 and hole 74 is positioned such that a 2 inch pipe is held in the jaw. These two pipe sizes are commonly used as axles for spools of wire, and the jaw 46 is configured to quickly and easily accept these two sizes. Removal of the pin 66 allows the clamping portion 54 to swing away from the base portion 50 at the pivot 58 to receive an axle. The use of the pin 66 and holes 70, 74, 78 is advantageous as it allows the clamping jaw 46 to be quickly locked around the commonly used pipe axles without tools.

The stand 10 also includes a front leg 82. The front leg 82 is telescopic, and includes an outer tube 86 and an inner tube 90. The inner tube 90 includes a plurality of holes 94 and the outer tube 86 includes a corresponding hole 98 such that a pin 102 may be passed through hole 98 and a hole 94 to fix the length of the front leg 82. The front leg 82 is pivotably attached to the base portion 50 of the jaw 46 at pivot 106, and includes a post 110 which is placed in one of a plurality of holes 114 formed in the base 14. The length of the front leg 82 may be adjusted along with the position at which the front leg is attached to the base 14 in order to accommodate spools of wire of varying sizes.

Figure 2:
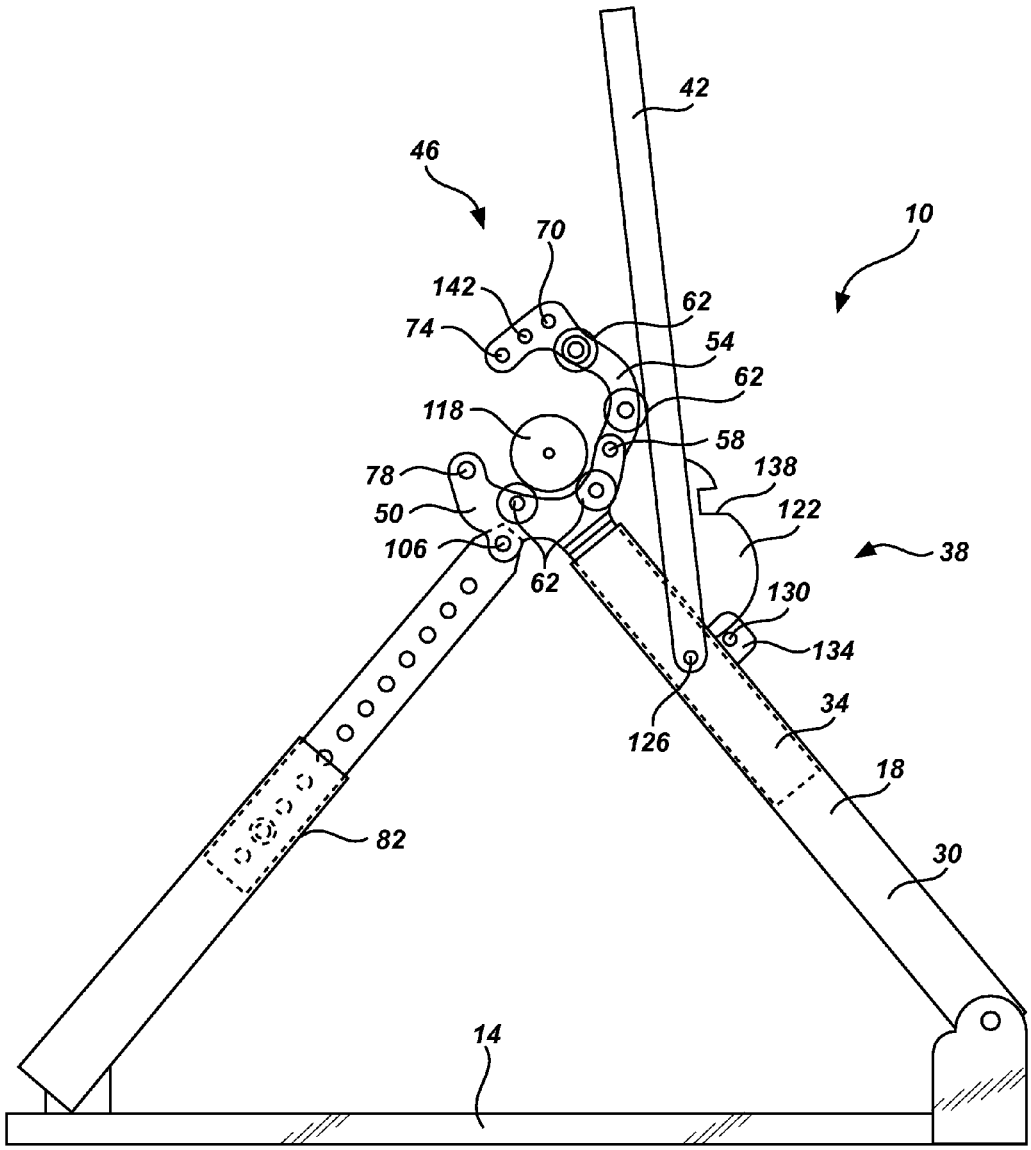
FIG. 2 shows a side view of the stand of FIG. 1.

FIG. 2 shows a side view of the stand 10. Several aspects of the stand are more easily visible. The pivot 106 is more easily seen. Also, the hole 78 on the base portion 50 of the jaw 46 is more easily seen. An axle 118 has been placed in the jaw 46. It can be seen how the axle 118 rests on the bearings 62 which are attached to the base portion 50

FIG. 2 also illustrates the jack, generally indicated at 38. The lever 42 has a semi circular cam 122 attached thereto and is attached to the inner tube 34 at pivot 126. The curved cam contacts a roller 130 which is supported by a pair of tabs 134 which are attached to the outer tube 30. Slots are formed in the inner tube 34 and outer tube 30 to allow the lever 42 and cam 122 to pivot. The lever 42 is shown rotated away from the rear leg 18 such that the inner tube 34 is retracted into the outer tube 30. As the lever 42 and cam 122 are pivoted in a clockwise direction towards the rear leg 18, the interaction between the cam 122 and the roller 130 pushes the inner tube 34 outwardly so as to lengthen the rear leg 18. The cam 122 has a segment 138 which, when the lever 42 is moved adjacent the rear leg 18, allows the inner tube 34 to retract slightly into the outer tube 30 from the maximum extended position such that the lever 42 and cam 122 are biased in a clockwise direction against the rear leg 18. The segment 138 of the cam 122 causes the weight of the wire spool to lock the rear leg 18 into an extended position.

A third hole 142 may be formed in the clamping portion 54 of the jaw 46 to accommodate a third size of axle, if desired. The jaw 46 may be sized such that the three holes 70, 74, 142 are used to hold 1.5 inch, 2 inch, and 2.5 inch axles in the jaw.

Figure 3:
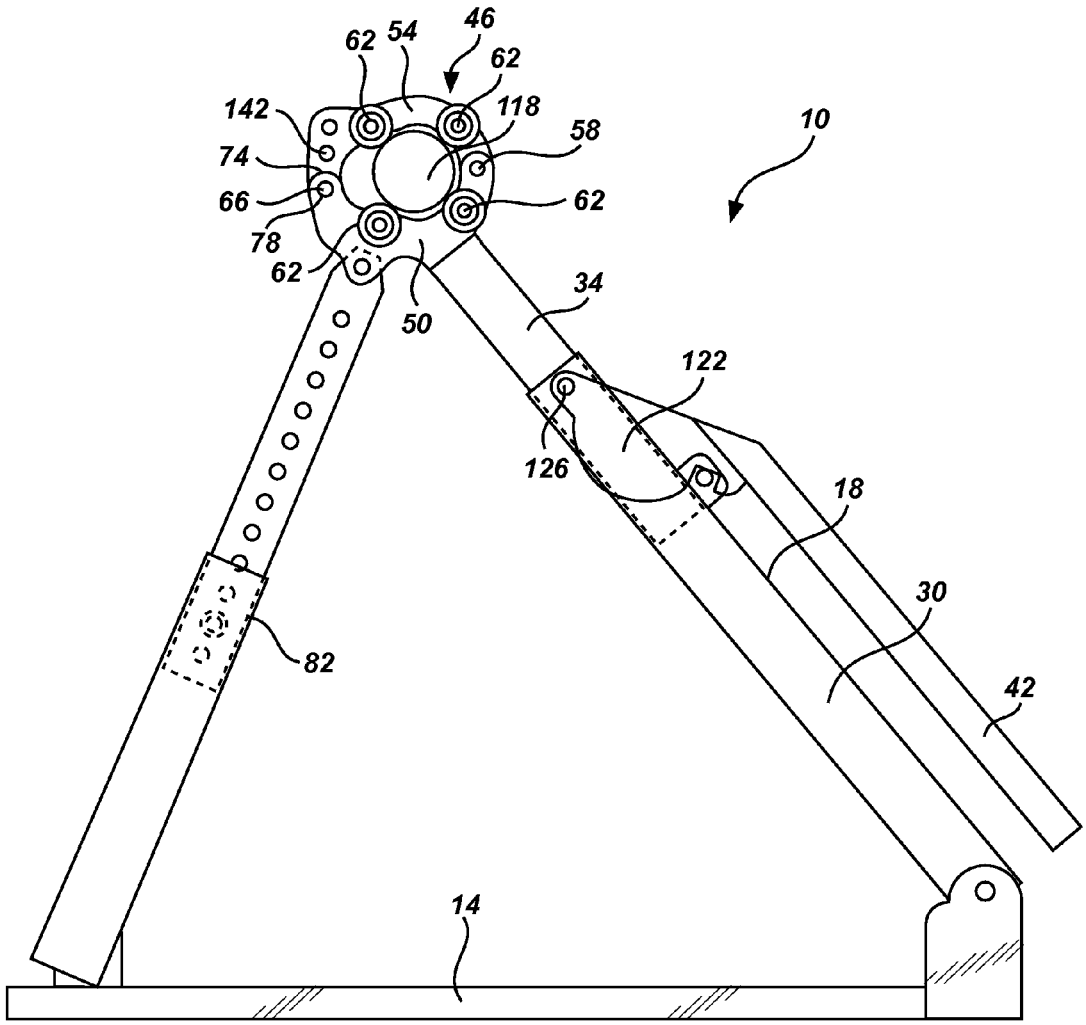
FIG. 3 shows a side view of the stand of FIG. 1.

FIG. 3 shows a side view of the stand 10 with the rear leg 18 in an extended position. It can be appreciated how lengthening the rear leg 18 will raise the axle 118 relative to the base 14, and thus lift a spool of wire off of the ground. The lever 42 and cam 122 and the positioning of the front leg 82 and rear leg 18 provide a high degree of mechanical advantage in lifting a spool of wire, and allow a single person to lift a spool of wire weighing a few thousand pounds or more.

The jaw 46 is closed around an axle 118. As such, the pin 66 is placed through a hole such as hole 74 in the clamping portion 54 and the hole 78 in the base portion 50. In such a position, the axle 118 contacts the bearings 62 and will turn freely as the wire is pulled from the spool.

Figure 4:
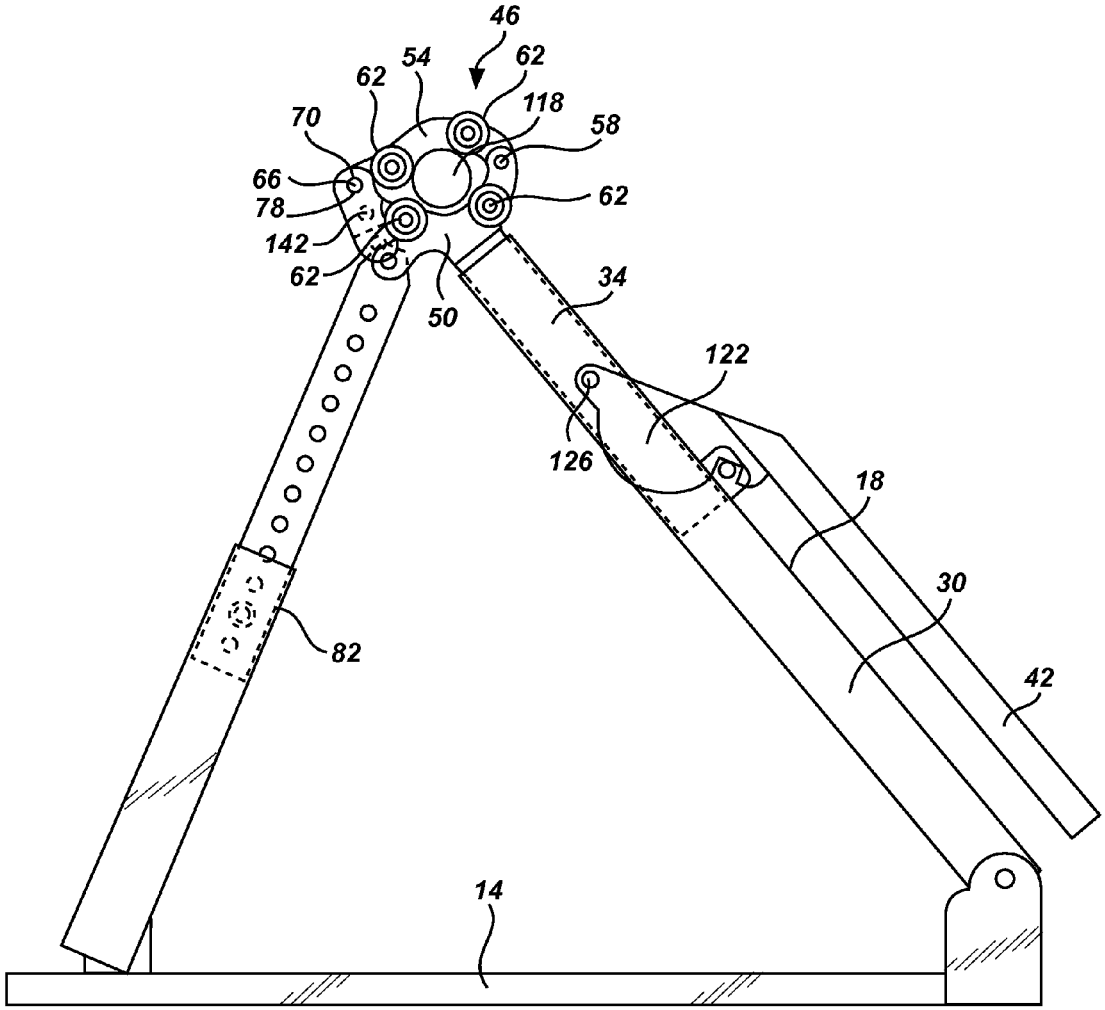
FIG. 4 shows a side view of the stand of FIG. 1.

FIG. 4 shows another side view of the stand 10, showing the stand in use with an axle 118 which has a smaller diameter than that shown in FIG. 3. To accommodate a smaller diameter axle 118, the pin 66 is placed through a hole such as hole 70 in the clamping portion 54 and through hole 78 in the base portion 50 of the jaw 46. As shown, the clamping portion 54 of the jaw 46 has multiple holes 70, 74 for holding the jaw closed around various sizes of axles as is desired. As discussed, a third hole 142 may be formed in the clamping portion 54 to accommodate three axle sizes, if desired.

FIG. 5 shows a perspective view of the jaw 46 in an open position. It can be seen how the base portion 50 and clamping portion 54 may include two sides (indicated with suffixes a and b) which are spaced apart and used to keep the axle 118 held perpendicular to the stand 10. As such, each side (a and b) of the clamping portion 54 and base portion 50 includes the holes 70, 74, 78, bearings 62, pivot 58, etc. The use of two sets of bearings 62 which are spaced laterally apart holds the axle perpendicular to the stand 10 and thereby keeps the stand from falling over laterally while in use. The stand 10 utilizes a long base and front and back legs 18, 82 which triangulate the jaw 46 and axle 118 above the base to provide front to back stability and prevent the spool of wire and stand from being pulled over forwards while in use.

FIG. 6 shows a perspective view of a stand 10 in a collapsed position for storage or transportation. In order to collapse the stand 10, the telescoping sections of the front leg 82 are collapsed in order to minimize the length of the front leg. The post 110 at the bottom of the front leg is removed from the base 14 and the front leg is pivoted at pivot 106 to place the front leg against the rear leg 18. The lever 42 is moved against the rear leg 18, extending the rear leg, and the rear leg 18 and front leg 82 are pivoted together via pivot 22 so as to place the front and rear legs adjacent the base 14. The jaw 46 is held closed by pin 66.

In such a position, a typical embodiment of the stand 10 is about 3 feet long, 4 inches wide, and 8 inches tall. Such as stand 10 is capable of holding 5 foot spools of wire when extended for use. The stand 10 is thus advantageous as it provides a very small collapsed size which is easily placed in a vehicle for transportation, and which will easily fit in many locations for storage. When transporting a stand 10, the person will often also be transporting wire, pulling rope, a wire puller, tools, etc. It is thus particularly important to provide a stand 10 which folds up into a compact size so that all of the necessary equipment may be transported easily. The long and narrow collapsed shape of the stand 10 is also advantageous as it helps keep the stand 10 from getting tangled up with the wire or rope which is being transported therewith. The stand 10 is thus advantageous as it is compact and easily transported and is still able to accommodate very large and heavy spools of wire.

The relatively simple design of the stand 10 provides a stand which weighs about 12 pounds, but which can support more than a thousand pounds each and which allows a person to quickly and easily lift a two thousand pound spool of wire off of the ground without any additional tools or power source.

FIG. 7 shows a perspective view of a pair of stands 10 used to support a spool of wire 146. Typically, two stands 10 are used to support either end of an axle 118 which is passed through the center of a spool of wire 146. In order to lift and support a spool of wire 146, an axle 118 is first passed through the spool. A stand 10 is placed on either end of the axle. Each stand 10 is placed upright with the base 14 on the ground. The lever 42 is moved away from the rear leg 18 to retract the inner tube 34, and the rear leg 18 is pivoted upwardly at pivot 22 until the jaw 46 is at about the height of the axle 118. The length of the telescoping front leg 82 is then adjusted via pin 102 and the pin 110 is placed in a hole 114 in the base 14 such that the jaw 46 is at or slightly below the height of the axle 118.

The jaw 46 is opened by removing pin 66 and pivoting the clamping portion 54 away from the base portion 50 at pivot 58. The axle 118 is placed in the jaw 46, and the jaw is closed and held in place with pin 66. Once both stands 10 are in place on either end of the conduit, the lever 42 of each stand 10 is pivoted downwardly towards the rear leg 18 to extend the rear leg 18 and raise the spool 146 off of the ground. In order to minimize side loads placed on the stands 10, the stands are typically used on a level surface, and the front leg 82 on each stand is extended to the same length and secured to the same hole 114 in the base 14.

The stand 10 is advantageous as a pair of stands 10 may be set up and used to lift a spool of wire 146 in only a few minutes. The stand 10 is also very convenient to use, requiring no tools and providing a very simple set up procedure. A single person can use two of the stands 10 to safely and easily raise a spool of wire 146 off of the ground and secure the spool of wire for installing wire in a conduit.

The base 14 of the stand 10 is about 3 feet long, and as such provides a secure stand 10 which is not easily pulled over when pulling wire off of the spool 146. The bearings 62 minimize the force required to pull wire off of the spool 146, minimizing the loads placed on the stand 10 during use. As discussed, the jaw 46 holds the axle 118 perpendicular to the stand 10 and prevents the stands 10 from falling over sideways under the weight of the spool of wire 146. It will be appreciated that, if used properly, little side loads will be placed on the stands 10. Although not always necessary, the stand 10 may be provided with rubber feet of the like attached to the base 14 to prevent the stand from sliding on the floor during use.

The stand 10 may also include various other types of jacks in place of the cam action jack 38 which is shown. The cam may be replaced with a hydraulic jack such as a bottle jack, a mechanical screw jack, or a mechanical ratcheting jack. These different types of jacks may be used to increase the amount of weight that a person can easily lift, allowing the stands 10 to be used with heavier spools of wire, etc. The cam action jack shown, however, is advantageous as it is self locking and provides a very quick movement to operate the stand and raise the spool of wire. In either case, the stand 10 is advantageous as it provides a more stable stand than available stands. The wide base 14 and the jaw 46 securely hold the spool and help keep the stand from tipping over or releasing the spool accidentally.

While discussed specifically with spools of wire, it will be appreciated that the stand 10 is also useful for holding spools of rope (as may be used in pulling wire), spools of utility pipe or tube, or many other spools of material which are to be installed in a similar manner.

There is thus disclosed an improved stand for lifting and holding spools of wire and the like. It will be appreciated that numerous changes may be made to the present invention without departing from the scope of the claims.

What is claimed is:

1. A stand for use in lifting a spool comprising:

a base having a first end and a second end and having a plurality of holes adjacent the second end thereof;

a rear leg having a first end pivotably attached to the base at the first end of the base and having a cam disposed therein such that rotation of the cam changes the length of the rear leg;

a jaw attached to a second end of the rear leg, the jaw being configured for holding a cylindrical axle;

a front leg having a first end pivotably attached to the jaw, the front leg having a post attached to the second end thereof, the post being positionable in the plurality of holes of the base; and wherein placing the post into one of the plurality of holes in the base places the stand into a triangular configuration with the front leg and rear leg extending upwardly from the base; and wherein the jaw is held above the base, and wherein actuation of the cam selectively raises and lowers the jaw relative to the base.

2. The stand of claim 1, wherein the front leg is telescopic so as to allow for adjustment of the length thereof.

3. The stand of claim 1, wherein the jaw is movable from an open position to a closed position, and wherein the jaw extends completely around an axle placed therein when the jaw is in the closed position.

4. The stand of claim 3, wherein the jaw has a plurality of holes formed therethrough and a locking pin such that the jaw may be selectively fixed in the closed position for a plurality of predetermined axle diameters.

5. The stand of claim 3, wherein the jaw comprises a plurality of bearings disposed thereon, the bearings being placed such that only the bearings contact the axle.

6. The stand of claim 5, wherein the bearings are placed such that the bearings contact the axle at two locations spaced apart laterally along the axle such that the bearings fix the orientation of the axle relative to the stand.

7. The stand of claim 1, wherein the stand is collapsible by pivoting the front leg against the rear leg and pivoting the front and rear legs against the base.

8. A stand configured for lifting and supporting a spool of wire comprising:

a base;

a clamping jaw configured for holding an axle, the clamping jaw comprising a plurality of holes formed therein such that the clamping jaw may be selectively locked in one of a plurality of closed positions so as to accommodate axles of different sizes;

a first leg pivotably attached to a first end of the base at a first end of the first leg and attached to the clamping jaw at a second end of the first leg;

a second leg attached to a second end of the base at a first end of the second leg and pivotably attached to the clamping jaw at a second end of the second leg; and wherein one of the first and second legs is selectively extendable and retractable so as to selectively raise the height of the clamping jaw relative to the base and thereby lift a spool of wire off of the ground.

9. The stand of claim 8, wherein the second leg is selectively attachable to the base at a plurality of positions along the base.

10. The stand of claim 8, wherein one of the first and second legs is selectively extendible via a lever and the other of the first and second legs is adjustable in length via a telescoping section and a locking member.

11. The stand of claim 8, wherein the first leg is selectively extendable via a lever and a cam.

12. The stand of claim 11, wherein the length of the second leg is adjustable via a telescopic section and a locking pin.

13. The stand of claim 8, wherein the clamping jaw comprises a base portion attached to the first leg and a clamping portion which is pivotably attached to the base portion so as to enable the clamping jaw to close completely around the axle.

14. The stand of claim 13, wherein the base portion has at least one hole formed therein and wherein the clamping portion has at least one hole formed therein and wherein a pin may be selectively passed through the at least one hole in the base portion and the at least one hole in the clamping portion to selectively lock the clamping jaw closed around the axle.

15. The stand of claim 13, wherein at least one of the base portion and clamping portion comprises the plurality of holes.

16. The stand of claim 13, wherein the clamping jaw comprises a plurality of bearings attached thereto such that the bearings support the axle and the clamping jaw allows the axle to freely rotate.

17. The stand of claim 8, wherein the stand collapses for storage by pivoting the second leg against the first leg and pivoting the first and second legs against the base.

18. A stand for lifting and supporting a spool of wire comprising:

an elongate base;

a clamping jaw, the clamping jaw having a base portion and a clamping portion pivotably attached to the base portion so as to enable the clamping jaw to enclose an axle, wherein at least one of the clamping portion and the base portion comprises a plurality of holes formed therein such that the clamping jaw may be selectively locked in one of a plurality of closed positions so as to accommodate axles of different sizes;

a first leg having a first end pivotably attached to a first end of the elongate base and having a second end rigidly attached to the clamping jaw, the first leg being selectively extendable via a lever so as to allow a person to selective raise the clamping jaw relative to the base and thereby raise a spool of wire; and a second leg having a first end selectively attachable to the base at a plurality of locations along the base and generally adjacent a second end of the base, the second leg having a second end pivotably attached to the clamping jaw.

19. The stand of claim 18, wherein the length of the second leg may be adjusted.

20. The stand of claim 19, wherein the second leg comprises an outer member and an inner member which is telescopically movable within the outer member, and wherein the position of the inner member may be selectively fixed relative to the outer member.

21. The stand of claim 18, wherein the first leg comprises an outer member and an inner member slidable within the outer member, and wherein the first leg comprises a cam and a lever attached to the cam such that rotation of the cam via the lever causes selective extension and retraction of the inner member relative to the outer member.

22. The stand of claim 18, wherein the clamping jaw comprises a plurality of bearings attached thereto such that the axle clamped therein contacts the bearings and rotates freely.

* * * * *